US008726823B2

(12) United States Patent
Kristinsson

(10) Patent No.: US 8,726,823 B2
(45) Date of Patent: May 20, 2014

(54) BOAT HULL

(75) Inventor: Ossur Kristinsson, Kopavogur (IS)

(73) Assignee: Mallard S.A., Luxembourg (LU)

( * ) Notice: Subject to any disclaimer, the term of this patent is extended or adjusted under 35 U.S.C. 154(b) by 196 days.

(21) Appl. No.: 13/550,977

(22) Filed: Jul. 17, 2012

(65) Prior Publication Data

US 2013/0019789 A1 Jan. 24, 2013

Related U.S. Application Data

(60) Provisional application No. 61/509,223, filed on Jul. 19, 2011.

(51) Int. Cl.
*B63B 1/00* (2006.01)

(52) U.S. Cl.
USPC ..... 114/61.32; 114/61.33; 114/40; 114/291

(58) Field of Classification Search
USPC ..... 114/61.32, 61.33, 40, 41, 291
See application file for complete search history.

(56) References Cited

U.S. PATENT DOCUMENTS

| | | | | | |
|---|---|---|---|---|---|
| 2,915,031 | A | * | 12/1959 | Johnston | 114/61.33 |
| 3,763,810 | A | | 10/1973 | Payne | |
| 4,506,617 | A | * | 3/1985 | Waas et al. | 114/41 |
| 4,638,753 | A | | 1/1987 | Marschewski | |
| 4,649,851 | A | | 3/1987 | April | |
| 4,715,305 | A | * | 12/1987 | Wilkman et al. | 114/40 |
| 4,726,310 | A | | 2/1988 | Ard et al. | |
| 4,753,184 | A | * | 6/1988 | Schiavone | 114/291 |
| 5,176,092 | A | * | 1/1993 | Czimmek | 114/40 |
| D337,302 | S | | 7/1993 | Van Lancker | |
| 5,497,722 | A | | 3/1996 | English, Sr. | |
| 6,223,679 | B1 | * | 5/2001 | Filipczak | 114/355 |
| 2004/0103462 | A1 | | 5/2004 | Verbickis et al. | |
| 2006/0254486 | A1 | * | 11/2006 | Ashdown | 114/39.25 |

OTHER PUBLICATIONS

ISR and Written Opinion for PCT/EP2012/064148, Oct. 24, 2012.

* cited by examiner

*Primary Examiner* — Lars A Olson
*Assistant Examiner* — Jovon Hayes
(74) *Attorney, Agent, or Firm* — Workman Nydegger

(57) ABSTRACT

A boat hull form includes a dual circular curved outer surface area that is circular concave relative to the plane of symmetry of the hull when viewed horizontally parallel with the plane of symmetry of the hull, and circular convex relative to the plane of symmetry when viewed vertically parallel with the plane of symmetry of the hull, with the hull outer surface area extending in a vertical sense from a lower area extending in a direction that tangentially intersects the plane of symmetry or optionally a plane extending parallel with the plane of symmetry on the same side of the plane of symmetry as the dual circular curved outer surface area and upwardly in a direction tangentially intersecting the waterline plane of the hull or a plane extending parallel to the waterline plane.

26 Claims, 9 Drawing Sheets

BOAT HULL

CROSS-REFERENCE TO RELATED APPLICATIONS

The benefit of Provisional Application No. 61/509,223 filed Jul. 19, 2011 is claimed and said provisional application is incorporated herein by reference.

BACKGROUND

A. Field

This invention relates to a boat hull, in particular a boat hull form or shape.

B. Related Background Information

In terms of marine engineering, boat hulls may be classified as "displacement" type, where the buoyancy of the boat is achieved fully through displacement of a corresponding weight of water, or "planing" of "semi-planing" hulls which, while supported by displacement of water at standstill or slow speeds, generate flotation by hydrodynamic forces acting on the hull at higher speeds such that the hull is supported to varying degrees on the bow wave. Thus planing hulls can reach higher speeds than displacement hulls with reasonable propulsion power demands due to reduced drag on the hull under planing conditions.

Displacement hulls have a theoretical hull speed that can be determined mathematically in a well-known manner depending on the length of the hull at the water line, and in general such speed can only be substantially exceeded by a hull without penalty of consumption of high power if the hull can be efficiently propelled at planing speed after being powered through a transition speed as the hull is driven through and over its bow wave. Displacement and planing hulls are thus typically designed to meet various but different specific objectives in terms of performance, speed, handling, load carrying ability, stability in various water conditions, etc. A hull that essentially is designed as a displacement type hull normally would not be expected to have characteristics of a planing hull, particularly in terms of speed vs. propulsion power, due to the drag characteristics of the wetted surface of a displacement hull and the fact that the displacement hull would not be optimized to achieve planing conditions with the power usually available in a displacement hull boat.

BRIEF SUMMARY OF THE INVENTION

A boat hull, according to a preferred example of the invention, is formed to have an outer hull surface area that has a dual circular curvature at least over a portion of the hull below the water line on either side of the hull vertical plane of symmetry (a vertical plane including the hull center line, also commonly referred to as a centerline plane). The dual circular curvature of the hull outer surface area is a circular curve form that is circular concave relative to the plane of symmetry when viewed horizontally parallel with the plane of symmetry, and circular convex relative to the plane of symmetry when viewed vertically parallel with the plane of symmetry. The circular curved hull outer surface area is formed so it extends in a vertical sense from a lower area preferably tangentially approaching the plane of symmetry of the hull (or optionally a plane that is parallel with the plane of symmetry) upwardly toward and approaching (or intersecting) the waterline plane (the horizontal plane including the hull waterline is herein is referred to as the waterline plane) or a plane extending parallel to the waterline plane. The dual circular curved hull outer surface area is also formed so that it extends in a horizontal sense from an area forward of the beam plane (a transverse vertical plane extending perpendicular to the plane of symmetry and including the hull beam) to an area aft of the beam plane.

The hull in actual form will have such a dual circular curvature symmetrically located on each side of the hull plane of symmetry. Such hull outer surface area may extend forward and aft of the beam plane over a distance less than the hull total length, and preferably will be provided with a planing (the term "planing" herein being intended to include semi-planing) hull section aft of the circular curved hull section, with a smooth transition between the circular curved hull section and the planing hull section.

Various circular curvatures may be used for designing the hull dual circular curved outer surface area according to the present invention, but all the curvatures will be circular and will be defined by beginning with a first imaginary circular curved arc segment located initially in the beam plane of a hull being designed on one side of the plane of symmetry of the hull, with a radius of the arc segment centered at a center of curvature likewise initially in the beam plane on the same side of the hull plane of symmetry as the arc segment. The lower end of the first imaginary arc segment typically tangentially approaches the hull plane of symmetry and the upper end of the arc segment tangentially approaches the waterline plane of the hull, or a plane extending parallel with the waterline plane. This first imaginary circular curved arc segment thus will be convex relative to the plane of symmetry when viewed along the hull length along the plane of symmetry of the hull.

To generate the dual circular curvature of the hull outer surface starting from the first imaginary circular curved arc segment located in the beam plane as just described, the first arc segment is rotated or swept about an imaginary axis of rotation that is located on the opposite side of the hull plane of symmetry in directions forward and aft of the hull beam plane. This will result in the loci of all points on the first arc segment described above tracing secondary imaginary circular curved arc segments located in planes extending parallel with the waterline plane and having radii centered on and along the imaginary axis of rotation.

The radius of the first imaginary circular curved arc segment that is initially located in the hull beam plane is smaller than the radii of the secondary arc segments, so that the curvature of the secondary imaginary circular curved arc segments will always be larger than the curvature of the first imaginary circular curved arc segment. The secondary arc segments also will be convex relative to the plane of symmetry when viewed vertically along the plane of symmetry as a result of the imaginary rotation of the first imaginary circular curved arc segment about the axis of rotation.

The actual dual circular curved hull outer surface area is obtained by using the imaginary geometrical area traced by the rotation or sweeping of the first imaginary circular curved arc segment in the manner described, but within limits imposed by the need to keep all the actual hull outer surface area thus obtained on one side of the hull plane of symmetry. Thus, although the dual curved area is generated by the rotation of the first imaginary circular curved arc segment in the manner described, only that portion of the generated area located on the one side of the hull plane of symmetry is used to obtain the actual dual circular curved hull outer surface area on one side of the hull plane of symmetry. Thus, the dual circular curved hull outer surface area at its outer limits will extend in a vertical sense downwardly in a direction tangentially approaching the plane of symmetry of the hull (or optionally a plane extending parallel with the plane of symmetry on the same side of the hull), and will extend upwardly in a direction that tangentially approaches the waterline plane of the hull or a plane extending parallel with and above the waterline plane. In a horizontal sense (parallel with the waterline plane), the circular curved hull outer surface area at its limits will extend from a forward area where the outer surface area intersects the plane of symmetry of the hull, to an aft area aft of the beam where the outer surface area again intersects the plane of symmetry of the hull.

In a downward sense, the extent of the dual circular curved outer hull outer surface may extend to any desired level consistent with hull design considerations, including a lower level terminating at a flat or other shaped keel area. In an upward direction, the dual circular curved outer hull surface area may intersect and terminate at the waterline plane of the hull with the imaginary extension of the curved outer hull area extending in a direction tangentially approaching a horizontal plane extending parallel with the waterline plane located above the waterline plane.

An actual boat hull outer surface area will possess the described circular curved outer surface area symmetrically on both sides of the hull plane of symmetry, so an opposite mirror dual circular curved hull outer surface area of the above-described dual circular curved outer hull surface area is provided on the opposite side of the hull plane of symmetry to obtain a full hull form in accordance with the invention. The forward area or bow of the actual boat hull thus typically will be formed by the intersection of the both opposite circular curved outer surface areas of the hull at the plane of symmetry of the hull. Aft of the beam plane, the opposite circular curved hull outer surface areas may intersect the plane of symmetry of the hull or may be terminated at any desired location consistent with hull design considerations and may be modified to merge smoothly into an aft planing hull form. The length of the circular curved outer hull surface area aft of the beam plane should be adequate to obtain good hydrodynamic drag characteristics and desired displacement characteristics for the boat hull.

An aft planing hull form with an optional deadrise and/or V or flat bottom may be provided aft of the circular curved hull outer surface area that is located amidships and forward of amidships to optimize the ability of the hull to minimize drag on the hull at cruising speeds. the planing hull form typically will lie just at or slightly below the waterline plane when the hull is at rest.

Optionally, while the opposite dual circular curved outer hull surface areas described are located below the waterline of the hull, extensions of the circular curved outer hull surface areas may be provided at opposite upper bow areas of the hull above the waterline as a continuation of the circular curved hull form to improve the wave cutting action of the hull in rough water or high seas and to achieve smooth cruising in waves and swells.

While a form of a dual circular curved outer hull surface area on one side of the hull plane of symmetry has been described above, a plurality of such dual circular curved outer surface areas vertically spaced one below the other on each side of the hull plane of symmetry may be provided, each circular curved outer surface area having smaller first and secondary radii than the first circular curved outer surface area above it. Each circular curved outer surface area will be connected to the other so as to form a smoothly graduated hull form with smaller circular curved outer surfaces from the waterline plane to the hull keel area, generated in a manner like the first circular curved hull outer surface area described above. Such configuration may be used when it is desired to limit the hull depth and/or to expand the beam length for a given displacement of a boat provided with the described dual circular curved outer surface areas.

Various choices of radius lengths for the first and secondary arc segments will determine the basic hull configuration in accordance with the invention so that hull performance and displacement characteristics can be designed and optimized for any desired boat configuration.

Notably, a hull featuring the dual circular curved form according to the invention results in surprising performance enhancement of the hull in terms of power required to drive the hull up to and exceeding theoretical hull speed, and stability of the hull in both smooth and rough water, with the displacement of the hull remaining below the waterline at all times. The hull, in effect, while basically functioning as a displacement hull, nevertheless possess attributes of a planing hull, at least in terms of speed vs. propulsion power.

As used herein, the term "circular" is intended to include precisely and mathematically circular, as well as substantially or essentially circular forms or contours, the latter including small deviations from or approximate variations of precise circular forms over at least a portion of an otherwise circular contour that function in regard to this invention substantially in the manner of a circular contour. In the context of the inventive boat hull, circular hull contours have been tested and the performance and efficiency of same are predictable and known. It is understood, however, that some deviation from precise circular curves or segments as used for the inventive boat hull might function in approximately the same or equivalent manner without a significant sacrifice of performance or efficiency as compared with circular hull contours. Thus, in the following description and claims, the term "circular" as used to describe a curve or contour is intended to encompass precisely circular curves and contours, as well as substantially circular curves and contours that result in a boat hull that performs substantially as well and efficiently as a boat hull in which the described dual circular curves and contours are used.

BRIEF DESCRIPTION OF THE DRAWINGS

With reference to the appended drawings.

DETAILED DESCRIPTION OF PREFERRED EXAMPLES OF THE INVENTION

Figure 1:
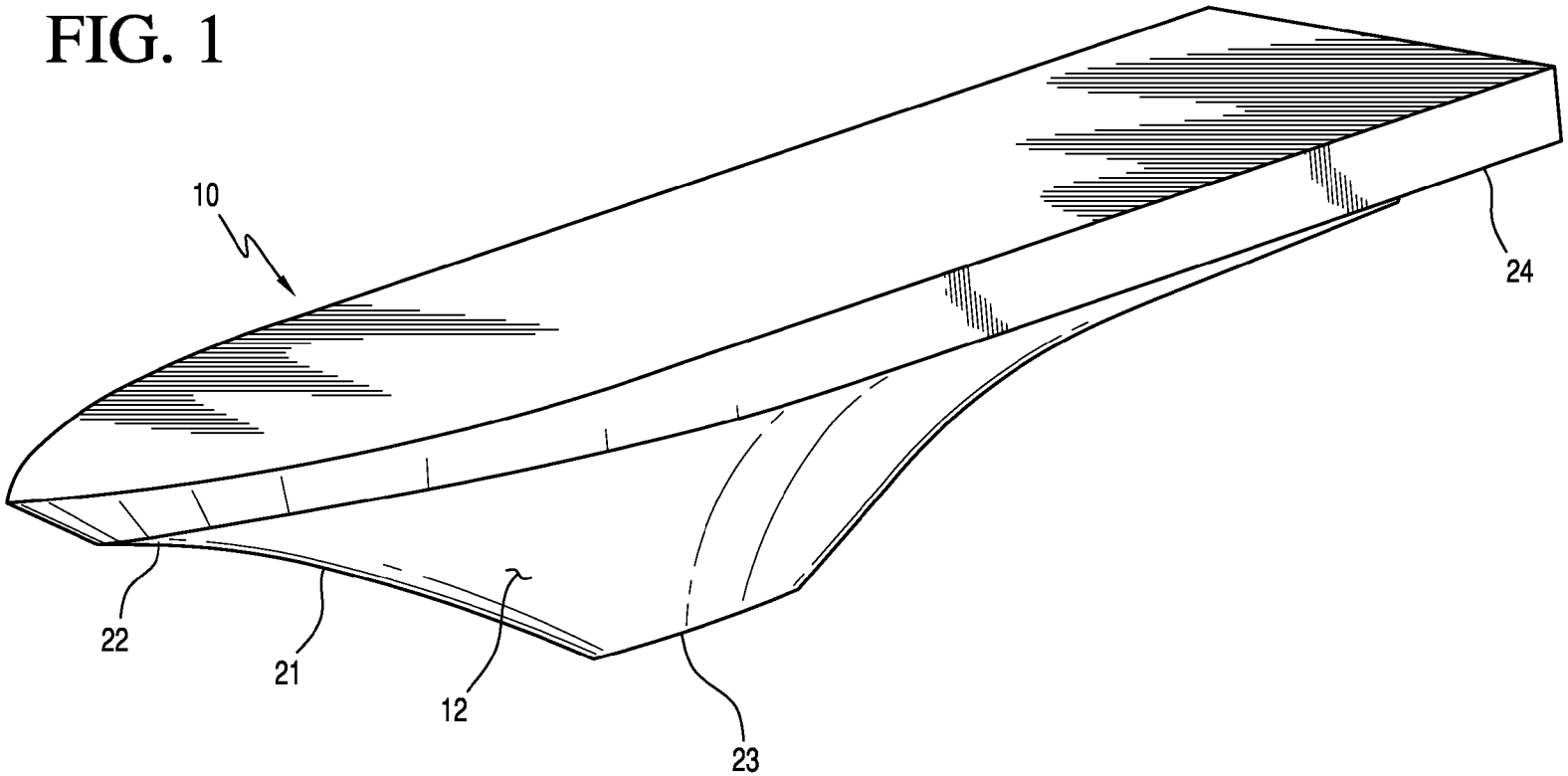
FIG. 1 shows a perspective view of a basic boat hull form made according to an embodiment of the invention, without superstructure, to illustrate the principle of the invention as it relates to the hull form.

With regard to FIGS. 1, 2 and 3, a boat hull 10 having a waterline plane WP that includes the waterline of the hull and a beam plane PB that includes the beam of the hull 10 is illustrated, with an external hull form below the waterline plane WP that includes a dual circular curved hull outer surface area 12 formed on one side of the longitudinal vertical plane of symmetry PS of the hull 10. A mirror image of the dual circular curved hull outer surface area 12M is provided on the opposite side of the hull plane of symmetry PS, as seen in FIG. 3.

The hull 10 comprises at least in part a first circular curved hull outer surface area 12 extending below the waterline plane WP and that is defined by a geometric area generated as a result of rotating or sweeping a first imaginary circular curved arc segment 14 (see FIG. 11*a*) having a first arc length L1 and a first radius R1 centered at a first center C1 located on one side of the plane of symmetry PS about an imaginary axis of rotation X extending vertically in the beam plane PB and located on the opposite side of the hull 10 from the first imaginary circular curved arc segment 14.

The first center C1 of the first imaginary circular curved arc segment 14 is located below the waterline plane WP outboard of the hull 10 on a same side of the hull plane of symmetry PS as the first imaginary circular curved arc segment 14 and the imaginary axis of rotation X is located on an opposite side of the plane of symmetry PS from the first center C1 (see FIG. 11*a*).

The imaginary first circular curved arc segment 14 and its first center C1 are initially located in the beam plane PB, with a lower end 15 of the first imaginary circular curved arc segment 14 extending in a direction tangentially approaching the plane of symmetry PS or a plane PP (see FIG. 11*b*) extending parallel to the plane of symmetry located on the same side of the plane of symmetry PS as the first imaginary circular curved arc segment 14 and first center C1, and an upper end 16 of the first imaginary circular curved arc segment 14 extending in a direction tangentially approaching the waterline plane WP or a plane WPP extending parallel with and above the waterline plane WP. Typically, the lower end 15 of the first imaginary circular curved arc segment 14 will be configured to tangentially approach the plane of symmetry as shown in FIG. 11*a*, but it may be desired to have the lower end 15 approach a plane PP that extends parallel with the plane of symmetry PS as illustrated in FIG. 11*b*, with appropriate adjustments to the area generated by sweeping the first imaginary circular arc segment 14 about the axis X to maintain the actual first circular curved hull form on the same side of the parallel plane PP.

Figure 11A:
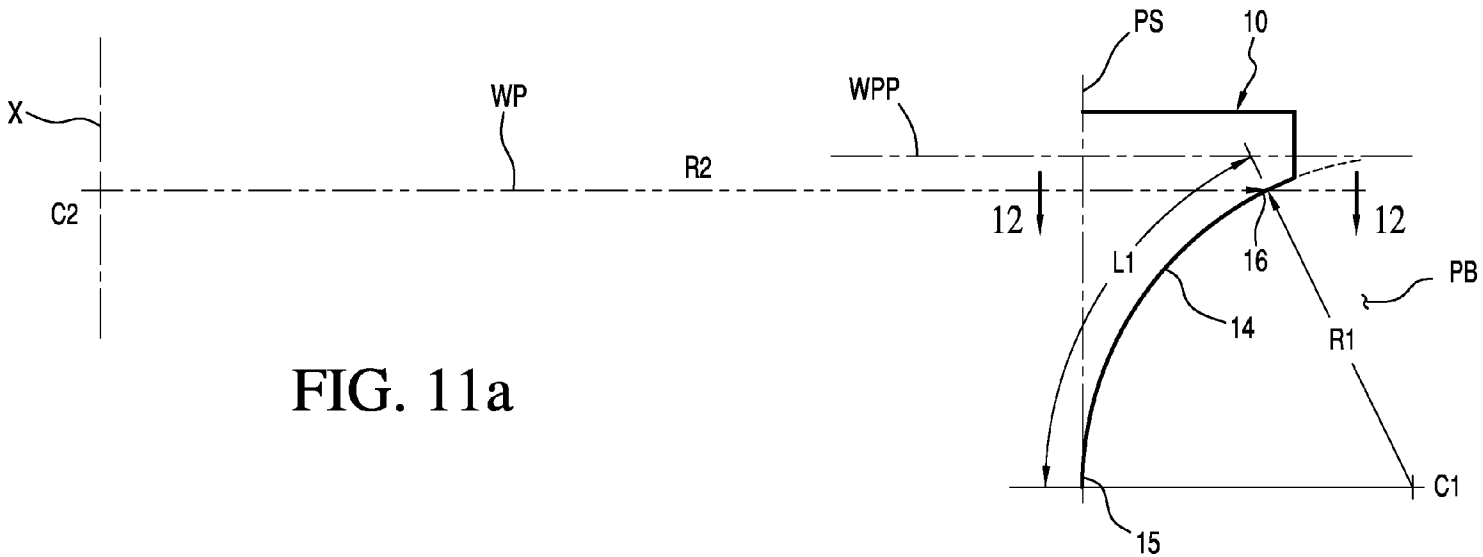
FIGS. 11*a*, 11*b* and 12 illustrate the basic geometry underlying the form of the boat hull shown in FIG. 1.
Figure 11B:
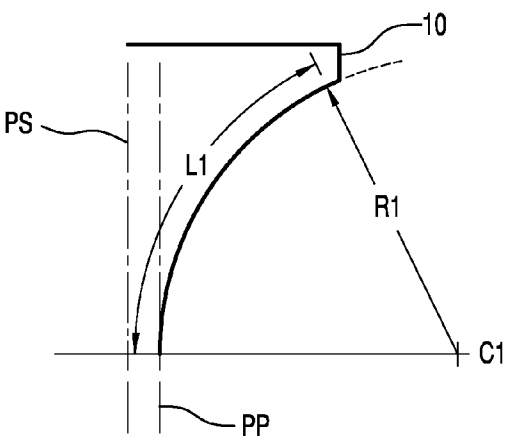
Figure 12:
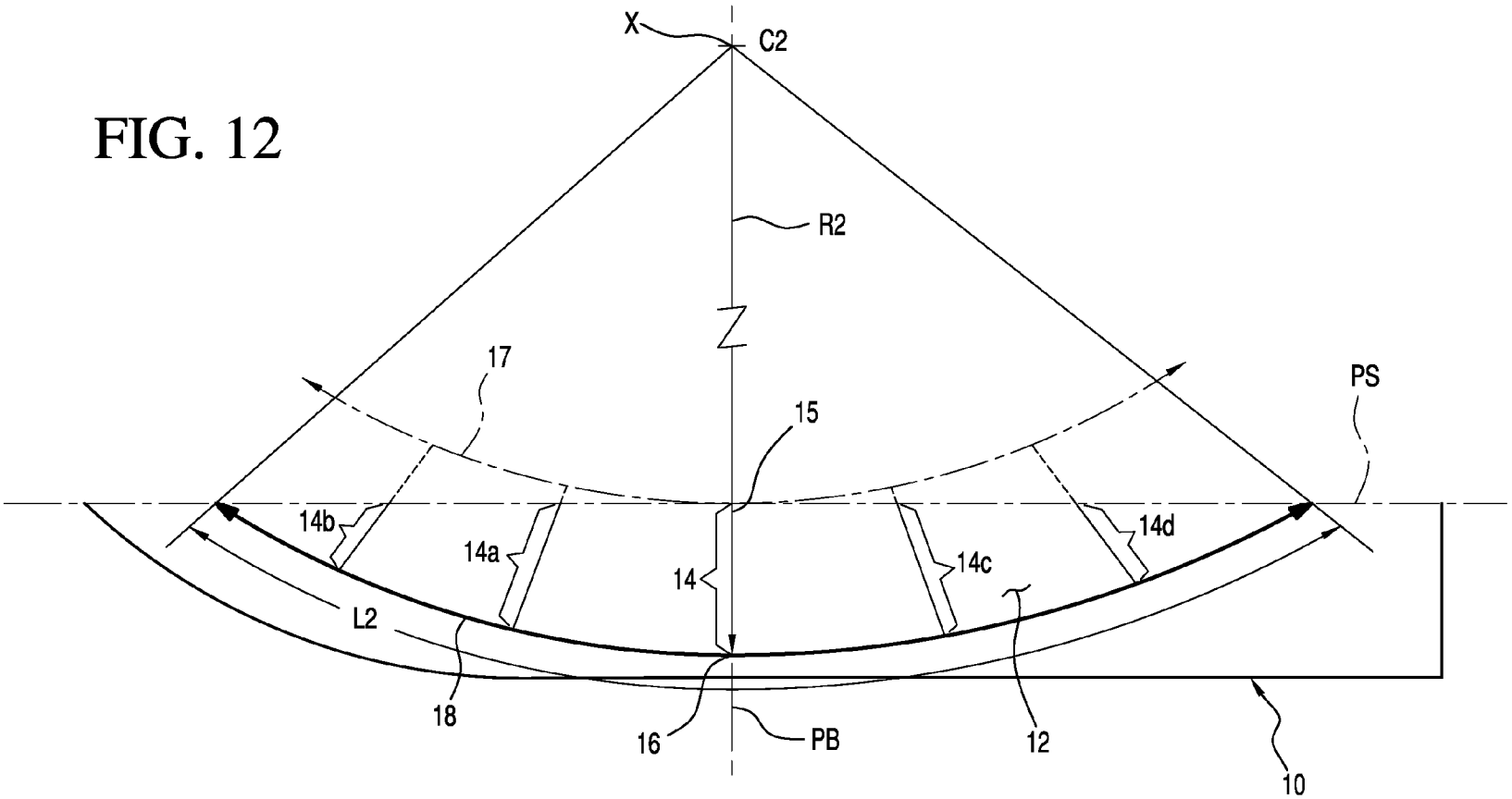

Assuming the situation shown in FIG. 11*a*, the sweeping of the first imaginary circular curved arc segment 14 is caused by rotating the first imaginary circular curved arc segment 14 forward and aft of the beam plane PB about the imaginary axis of rotation X so that the loci of all points of the first imaginary circular curved arc segment 14, including the upper end 16, fore and aft of the beam plane PB, follow secondary imaginary circular curved arc segments, including a secondary uppermost circular arc segment 18 traced by upper end 16 of arc segment 14, with all secondary arc segments including circular arc segment 18 having a respective secondary radius centered along the imaginary axis of rotation X. As shown in FIGS. 11 a and 12, the uppermost secondary circular arc segment 18 has a second arc length L2 having second radius R2 centered at second center C2 located on axis X. A lowermost secondary circular curved arc segment 17 having its center on axis X below second center C2 is shown in FIG. 12 to illustrate the theoretical arc traced by the lower end 15 of first imaginary circular curved arc segment 14 when the arc segment 14 is swept about axis X. The first imaginary circular curved arc segment 14 between its upper end 16 and lower end 15 is shown in FIG. 12 initially at the beam plane PB, and then the arc segment portions extending between the upper end 16 of the first imaginary circular curved arc segment 14 and the plane of symmetry PS are shown at 14*a*, 14*b* as the arc segment 14 is rotated in a forward direction about axis of rotation X, and at 14*c*, 14*d* as the arc segment 14 is rotated aft bout axis X. As will be explained in more detail below, the actual hull outer surface area 12 on one side of the plane of symmetry will be limited to the portions of the area traced by the first imaginary circular curved arc segment 14 as it is rotated about rotation axis X that are located on one side of the plane of symmetry PS, and thus the imaginary arc segments shown as 14*a*, 14*b*, 14*c* and 14*d* reflect the portions of the imaginary arc segment 14 that define the actual dual circular curved outer surface area 12 of the hull 10.

The second center C2 and the secondary uppermost imaginary circular curved arc segment 18 typically are located in the waterline plane WP or a plane WPP extending parallel with and above the waterline plane WP at all times when the first imaginary circular curved arc segment 14 is swept about axis of rotation X (see FIG. 11).

The second radius R2 is greater than the first radius R1 and all portions of the first dual circular curved hull outer surface area 12 defined by the geometric area resulting from sweeping the first imaginary circular curved arc segment 14 bout axis of rotation X are located on the same side of the plane of symmetry PS, so that the first hull outer surface area 12 has the form of a circular curve that is circular concave relative to the plane of symmetry PS when viewed horizontally parallel with the plane of symmetry PS, and circular convex relative to the plane of symmetry PS when viewed vertically parallel with the plane of symmetry PS, with the first hull outer surface area 12 extending in a vertical sense from a lower area at or approaching the plane of symmetry (or optionally a plane extending parallel with the plane of symmetry), upwardly toward and approaching or intersecting the waterline plane WP or a plane extending parallel to and above the waterline plane WP, and in a horizontal sense from an area forward of the beam plane PB to an area aft of the beam plane PB.

The actual dual circular curved hull outer surface area 12 is obtained by using the imaginary geometrical area traced by the rotation or sweeping of the first imaginary circular curved arc segment 14 in the manner described, but within limits imposed by the need to keep all the hull outer surface thus obtained on one side of the hull plane of symmetry PS. Thus, although the circular curved outer surface area 12 is generated by the loci of the first arc segment 14 during the sweeping or rotation of the first imaginary circular curved arc segment 14 in the manner described, only that portion of the generated hull outer surface area located on one side of the hull plane of symmetry PS is used to obtain the actual first dual circular curved hull outer surface area 12 on one side of the hull plane of symmetry PS. Accordingly, the dual circular curved hull outer surface area 12 at its theoretical outer limits may extend in a vertical sense downwardly to where it tangentially reaches the plane of symmetry PS (or optionally a plane PP extending parallel with the plane of symmetry PS of the hull 10 and on the same side of the plane of symmetry as the first center C1 as shown in FIG. 11*b*) and in a direction upwardly to where it tangentially approaches the waterline plane WP or a plane extending parallel with and above the waterline plane. In a horizontal sense (in a direction parallel with the plane of symmetry along the hull length), the hull dual outer surface area 12 at its outer limits will extend from a forward area where the outer surface area 12 intersects the plane of symmetry PS to an aft area rearward of the beam plane PB where the outer surface area 12 again intersects the plane of symmetry PS.

In a vertically upward sense, the extent of the dual curved outer hull surface area 12 normally will be limited to the waterline plane WP as a maximum upper level, with the curved outer surface area 12 of the hull intersecting and terminating at the waterline plane as it extends upwardly, with the imaginary extension of the hull outer surface area 12 tangentially approaching a horizontal plane WPP that is located above and extends parallel with the waterline plane WP, although the circular curved hull outer surface area 12 could extend above the waterline plane WP if desired. Selection of the actual upper extent of the hull dual circular curved outer surface area 12 relative to the waterline plane WP of the hull 10 will depend on hull design factors, including desired displacement characteristics of the hull, performance characteristics of the hull, hull beam, hull overall or waterline length, etc. The upper end of the dual circular curved area 12 of the hull will usually not be below the hull waterline or waterline plane WP and typically will be somewhat above the waterline plane WP.

In a vertically downward sense, the extent of the dual circular curved outer hull surface area 12 may extend to any desired level consistent with hull design considerations, including a lower level terminating at a flat keel 23 area or other shaped keel area. The circular curved hull 12 will not extend below the point of tangency with the plane of symmetry PS (or a vertical plane PP extending parallel with the vertical plane of symmetry PS and located on the same side of the plane of symmetry as the first center C1).

An actual boat hull 10 will possess the described first dual circular curved outer surface area 12 symmetrically on both sides of the hull plane of symmetry PS (see FIG. 3-10), so an opposite mirror dual circular curved hull outer surface area 12M of the above-described dual circular curved outer hull surface area 12 is provided on the opposite side of the hull plane of symmetry PS to obtain a full hull form in accordance with the invention. The bow 21 of the boat hull 10 thus typically will be formed by the convergence of the both opposing outer dual circular curved hull outer surface areas 12, 12M at the plane of symmetry of the hull. Aft of the beam plane PB, the dual circular curved hull outer surface area 12 may be terminated at any desired location consistent with hull design considerations and may be modified to merge smoothly into an aft planing hull form 24 of any desired configuration.

Figure 4:
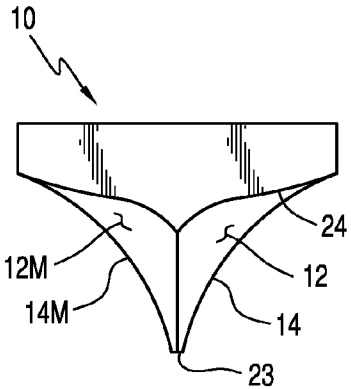
FIG. 4 shows a rear view of FIG. 1.
Figure 10:
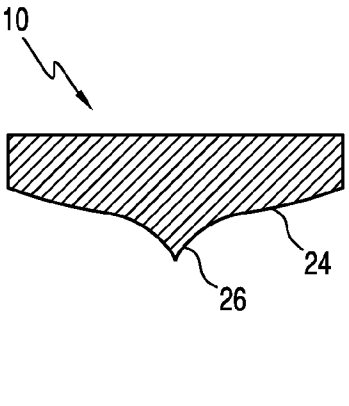

The aft planing hull form 24 may have an optional deadrise and/or a V bottom 26 or may be flat, and may be provided aft of the dual circular curved outer surface area 12 that is located amidships and forward of amidships as illustrated to assist in supporting the aft area of the hull at cruising speeds, as seen in FIGS. 4 and 10.

Optionally, while the dual circular curved hull outer surface area 12 described is located below the waterline of the hull, extensions 22 of the dual circular hull surface areas may be provided at upper bow areas of the hull above the waterline plane WP as a continuation of the circular curved hull outer surface areas 12, 12M to smoothen the wave cutting action of the bow in rough water or high seas.

Figure 2:
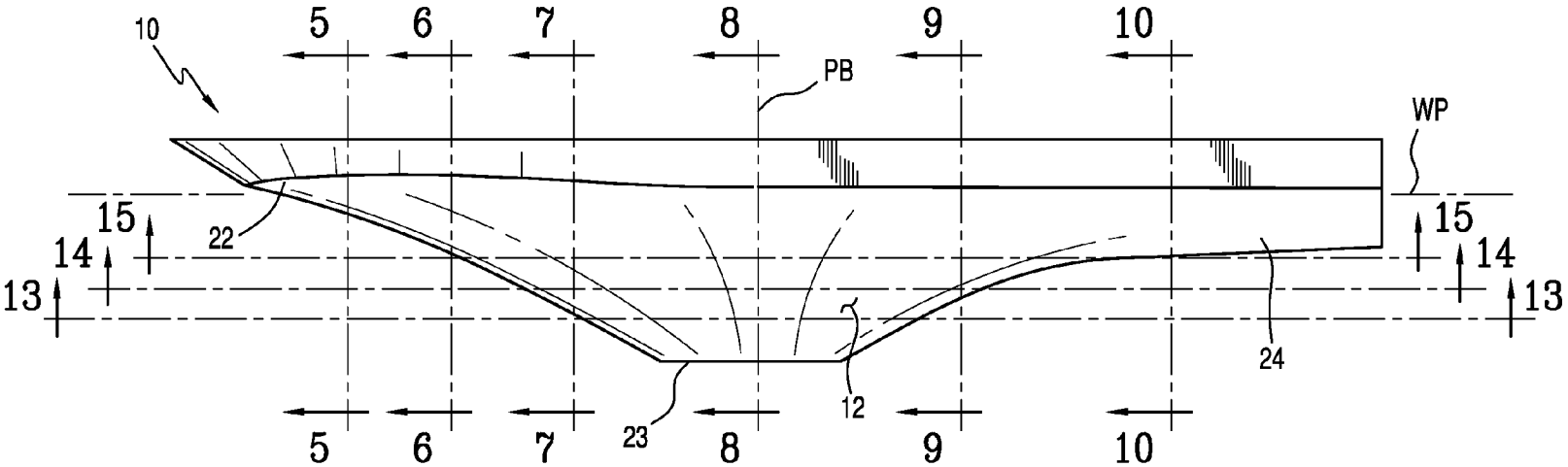
FIG. 2 shows a side elevation view of FIG. 1.
Figure 3:
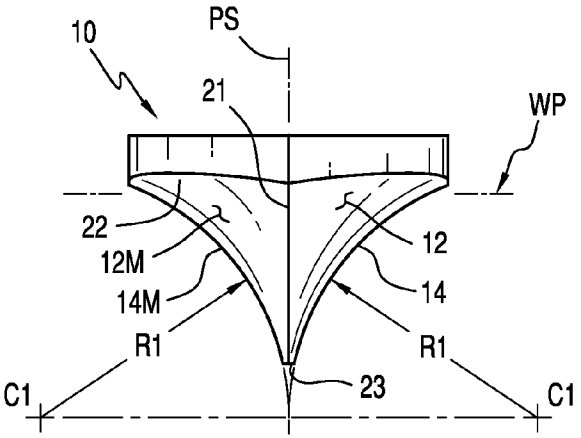
FIG. 3 shows a front view of FIG. 1.
Figure 5:
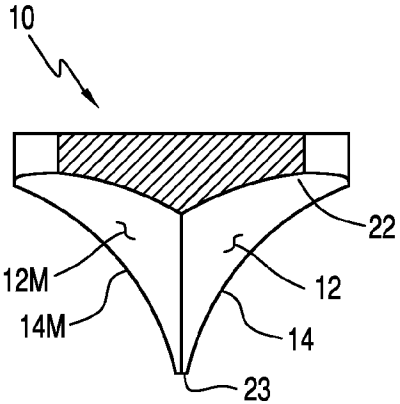
FIGS. 5-10 show section views taken along lines 5-5 through 10-10 in FIG. 1.
Figure 6:
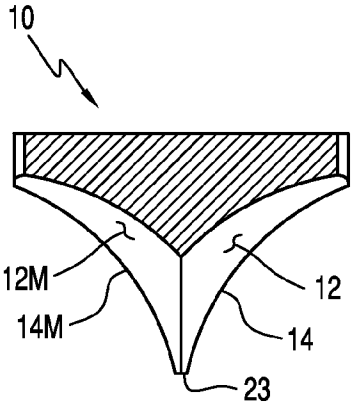
Figure 7:
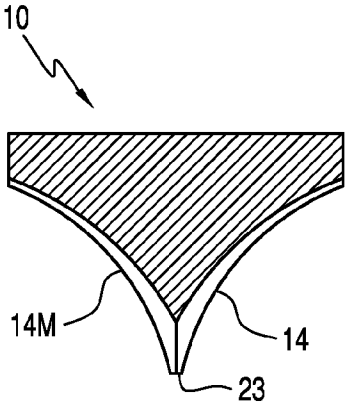
Figure 8:
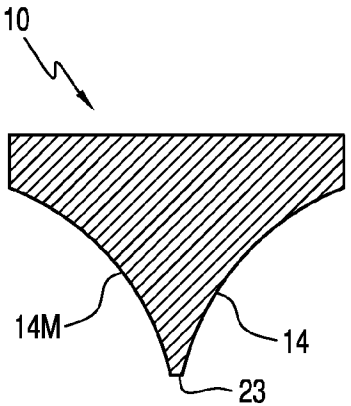
Figure 9:
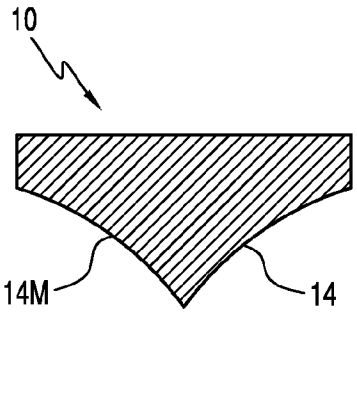
Figure 13:
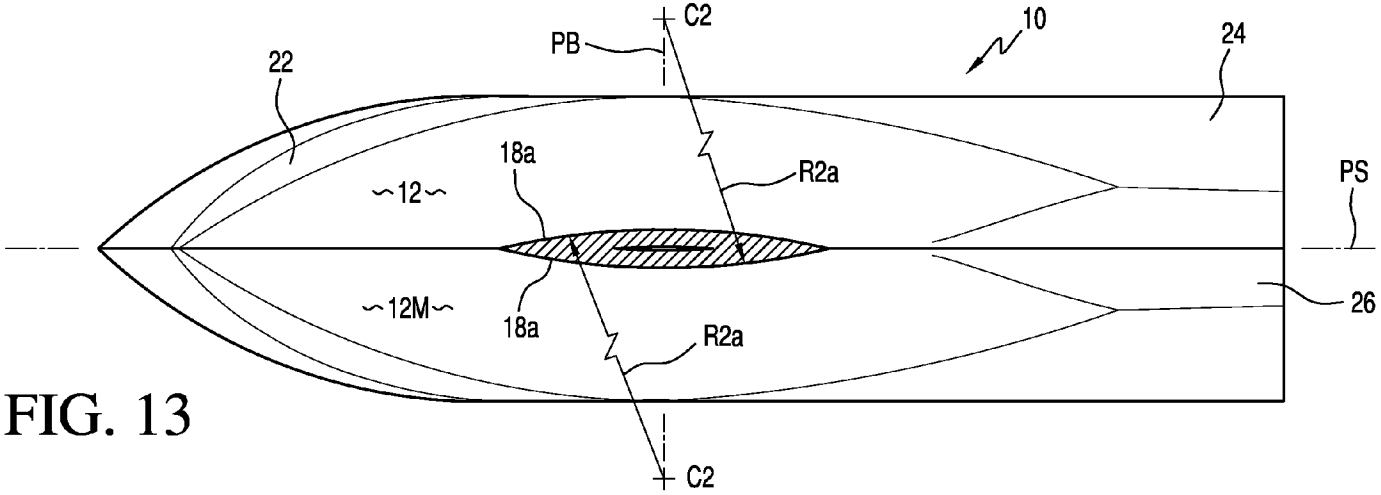
FIGS. 13-15 are section views taken along lines 13-13 through 15-15 in FIG. 1. IV.
Figure 14:
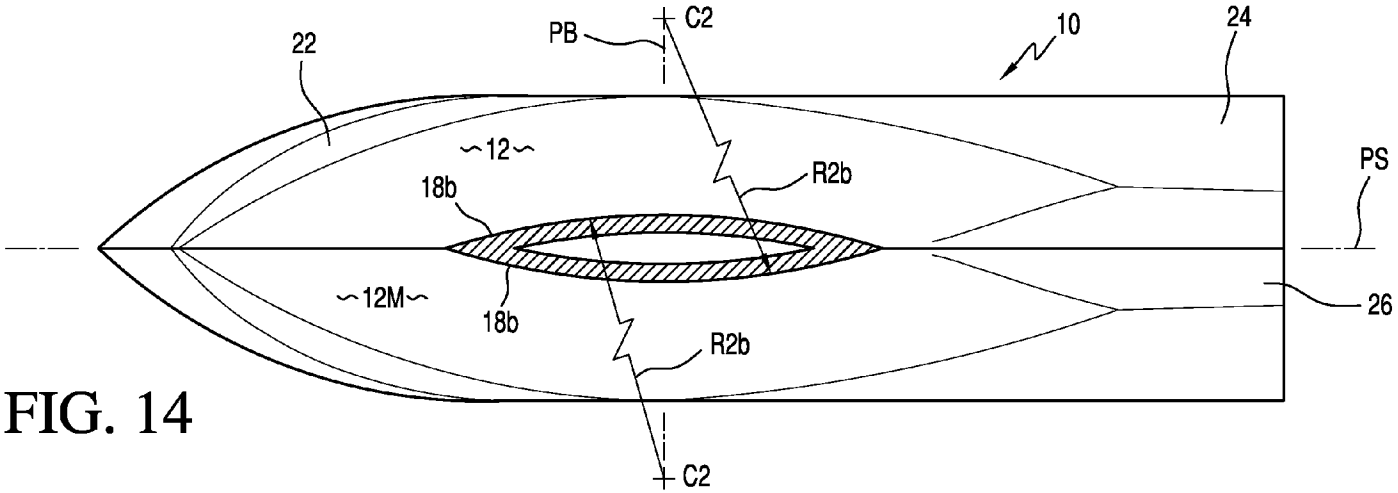
Figure 15:
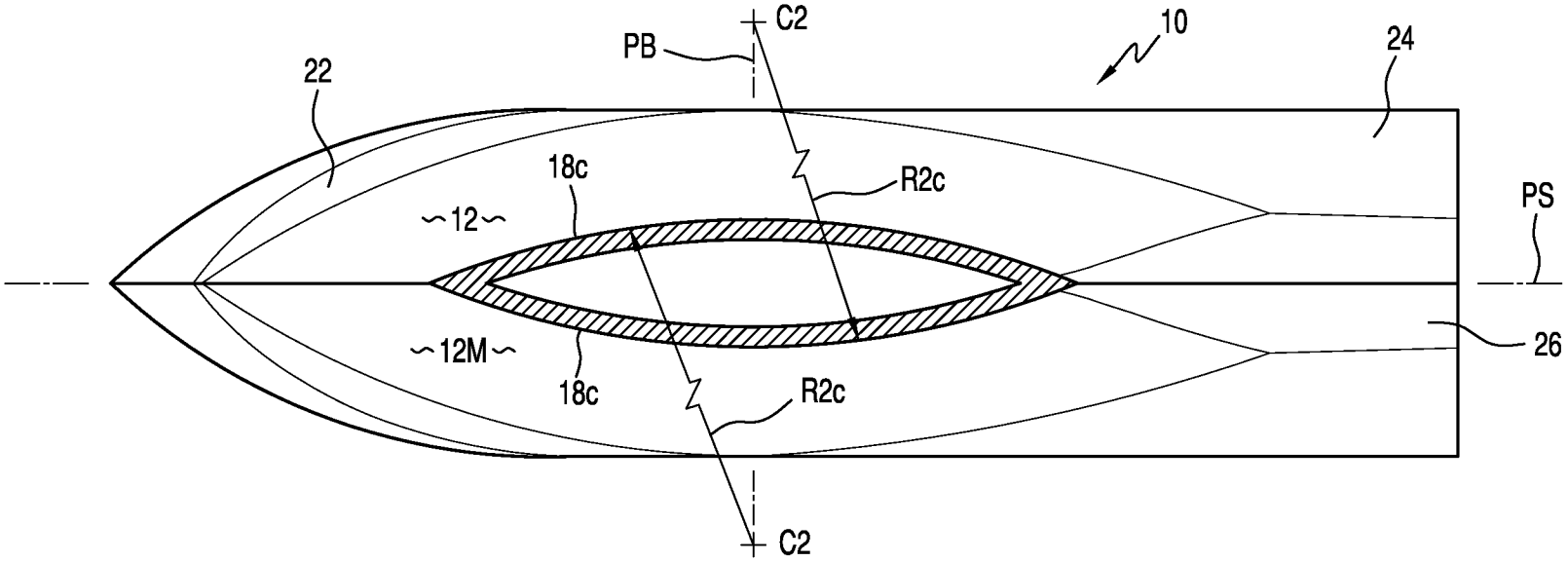

As further illustrated by the examples of FIGS. 1 and 2, and as better shown by FIGS. 13, 14 and 15 that are horizontal section views taken along sections lines 13-13, 14-14 and 15-15 in FIG. 2, the contour of each side of the hull along dual circular curved outer surface area 12 varies from a bottom to an upper area, but at each horizontal section the intersection of the horizontal section with the dual circular curved outer surface area 12 defines a circular arc segment 18*a*, 18*b*, 18*c* that is concentric with uppermost arc segment 18 and has a respective radius R2*a*, R2*b*, R2*c* that is centered along the imaginary vertical axis of rotation X that lies in beam plane PB along with first center C1 of first imaginary circular curved arc segment 14.

FIG. 3 further illustrates the hull form described above from the perspective of a front view of the hull, clearly showing the opposed lateral dual circular curved hull outer surface areas 12, 12M having the form obtained by sweeping opposed imaginary first circular curved arc segments 14, 14M having first radii R1, R1M centered at first centers C1, C1M on opposite sides of the hull plane of symmetry PS, and which are concave as viewed horizontally along the plane of symmetry PS.

The radii R1 and R2, and the circular arc lengths L1 and L2 are selected for any given hull form desired. Increases and decreases of radii R1 and R2, and variations of arc lengths L1 and L2, result in variations of hull beam, hull height (or depth), hull coefficients and variations of floatation with varying loading that may be utilized by the marine engineer or architect to design boat hulls that will achieve design speeds and displacements as desired with the advantages of the inventive dual circular curvatures of the hull outer surface area 12 located below the waterline of the hull.

The hull 10 is shown with a solid form in FIGS. 1-10 for illustrative purposes, but in actuality the hull typically would be a hollow form molded or shaped in accordance with conventional boat hull manufacturing methods to obtain an exterior contour and surface area having the external dual circular curved shape in accordance with this invention as described above, while including a hollow interior of any desired configuration within such exterior contour. The deck and superstructure accordingly could be made according to any desired form consistent with marine engineering principles, taking advantage of the deep hull shape resulting from the exterior contour made in accordance with the invention that can accommodate various machinery and accessories of the boat, including propulsion and drive components, for example.

Towards the after end of the hull, the circular curvatures of the hull surface area 12, 12M may be modified and streamlined to blend smoothly into a planing (this term including semi-planing) aft hull form 24, as shown in FIGS. 1, 2 and 10. Thus, the planing aft hull form in accordance with the example illustrated is shaped more as a planing hull, preferably having a mild V-shape as can be seen at 26 in FIG. 10, to obtain the advantages of reduced drag and higher efficiency at higher speeds of the hull and to provide increased stability at speed. The specific form of a planing aft hull form 24 will be selected to optimize the dynamic characteristics of the dual circular curved hull outer surface areas 12, 12M formed in accordance with the invention and may be iteratively derived from testing and experiments starting from different circular curved outer hull surface areas made in accordance with the invention. Likewise, the transition areas of the hull between the dual circular curved areas 12 and the planing aft hull form 24 may be selected to optimize the drag and stability characteristics of a specific hull form. In the example illustrated in the Figures, the hull outer surface areas 12 modulate smoothly in a streamlined manner from the dual circular curvatures described above to a mild V-bottom aft hull form 24 having a deadrise as seen in FIGS. 2 and 4. While not shown, hard or soft chines and/or strakes could be utilized at least at the hull planing form 24 if desired. Moreover, not illustrated in the drawings, the curvature of the first imaginary circular curved arc segments 14, 14M at the aft end of the hull could be extended aft into the upper areas of the planing area 24 in a smooth fashion to the transom of the hull with the area between the curved arc segments shaped with a mild V-form to provide the aft planing surface area. The planing area 24 typically will be located just below or at the waterline plane WP.

The present invention also includes the method aspects of generating a form of a dual circular curved outer surface area 12 for a given boat hull 10 having a waterline plane WP, a vertical beam plane PB and a vertical plane of symmetry PS, for enabling design of a boat hull possessing such dual circular curved outer surface area. The method involves the steps:

sweeping a first imaginary circular curved arc segment 14 having a first arc length L1 and a first radius R1 centered at a first center C1 about an imaginary axis of rotation X extending vertically in the beam plane PB to generate a geometric area defining the first outer surface area 12, the first center C1 being located below said waterline plane WP outboard of the hull on the same side of the hull as the first imaginary circular curved arc segment 14, the imaginary axis of rotation X being located on an opposite side of the plane of symmetry PS from the first center C1, the imaginary first imaginary circular curved arc segment 14 and said first center C1 initially being located in the vertical beam plane PB below said waterline plane WP on a same side of the plane of symmetry PS as the first imaginary circular curved arc segment 14, with said first imaginary circular curved arc segment 14 at a lower end 15 thereof, or an extension of said lower end, approaching tangentially said plane of symmetry PS (or optionally a plane PP extending parallel with said plane of symmetry located on the same side of the plane of symmetry as the first center C1), and an upper end 16 of the first imaginary circular curved arc segment 14, or an extension of said upper end 16, approaching tangentially the waterline plane WP, or a plane WPP extending parallel with the waterline plane WP, the sweeping of the first imaginary circular curved arc segment 14 being carried out so as to rotate the first imaginary circular curved arc segment 14 forward and aft of the beam plane PB so the loci of an upper end 16 of the first imaginary circular arc segment 14 forward and aft of the beam plane PB follow a second imaginary circular curved arc segment 18 centered at a second center C2 that is located on said axis of rotation X, the second center C2 and said second circular curved arc segment 18 being located in the waterline plane WP or a plane extending parallel with said waterline plane WP, the second radius R2 being greater than the first radius R1, while sweeping the first imaginary circular curved arc segment 14 fore and aft of the beam plane PB, maintaining all of the geometric area resulting from sweeping said first imaginary circular curved arc segment 14 defining the first dual circular curved hull outer surface 12 on the same side of the plane of symmetry PS, so that the first dual circular curved hull outer surface area 12 is formed as a curve that is circular concave relative to the plane of symmetry PS when viewed horizontally along the plane of symmetry PS, and circular convex relative to the plane of symmetry PS when viewed vertically along the plane of symmetry PS, with said first hull outer surface area 12 extending in a vertical sense from a bottom area at or approaching the plane of symmetry PS (or optionally a plane PP extending parallel with the plane of symmetry PS located on the same side of the plane of symmetry as the first center C1), and upwardly toward and intersecting the waterline plane WP or a plane extending parallel with said waterline plane WP, and in a horizontal sense from an area located forward of the beam plane PB to an area aft of the beam plane PB.

The inventive method aspects of the present invention also include forming the opposing mirror image dual circular curved outer surface areas 12, 12M of the hull; the opposing extensions 22 of the dual circular curved outer surface areas above the waterline plane WP at the bow of the hull; and forming the aft planing hull form 24 with a smooth transition between the aft hull form 24 and dual circular curved outer surface areas 12, 12M of the hull 10.

Figure 16:
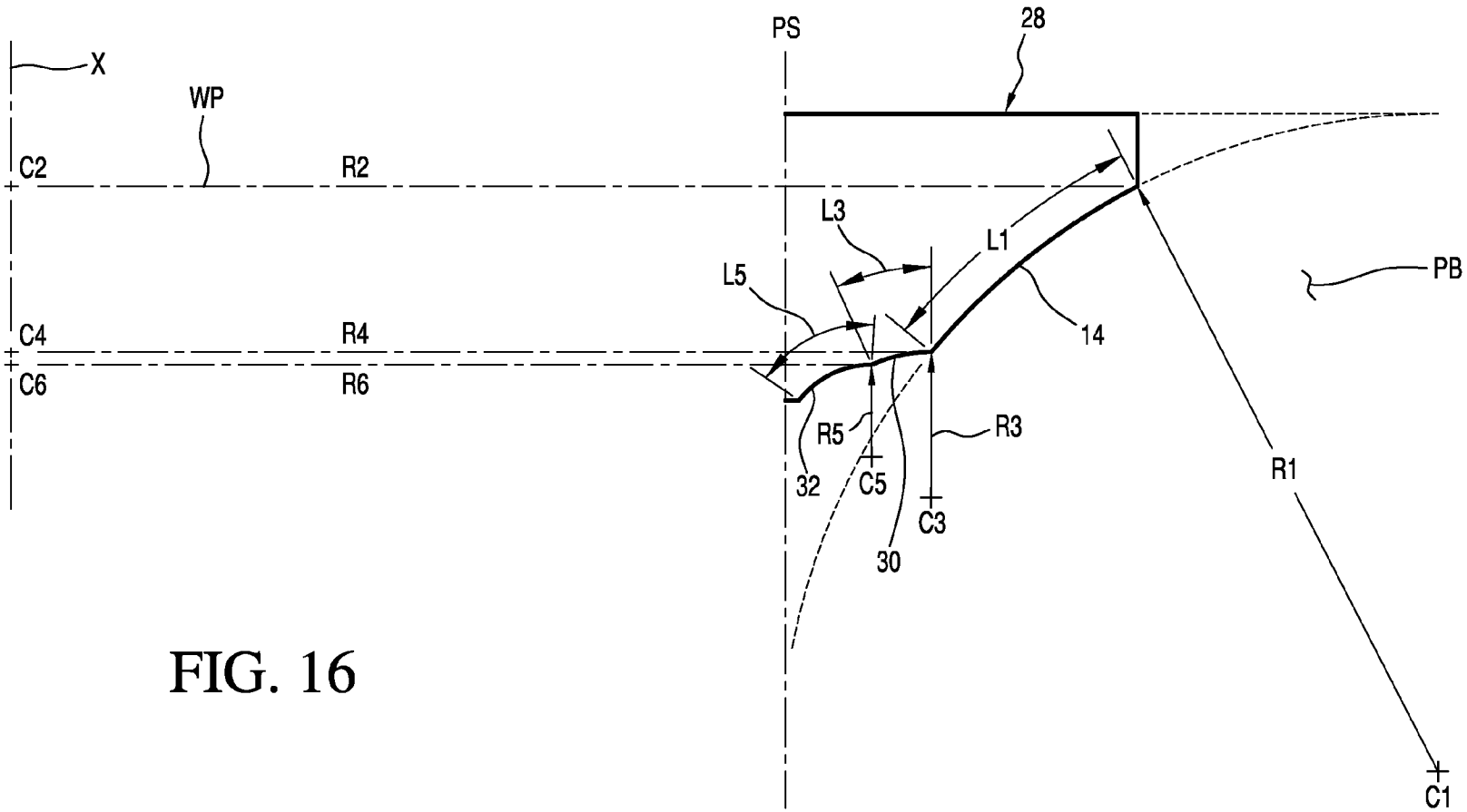
FIG. 16 shows a basic geometry underlying an alternate embodiment of the boat hull shown in FIG. 1.
Figure 17:
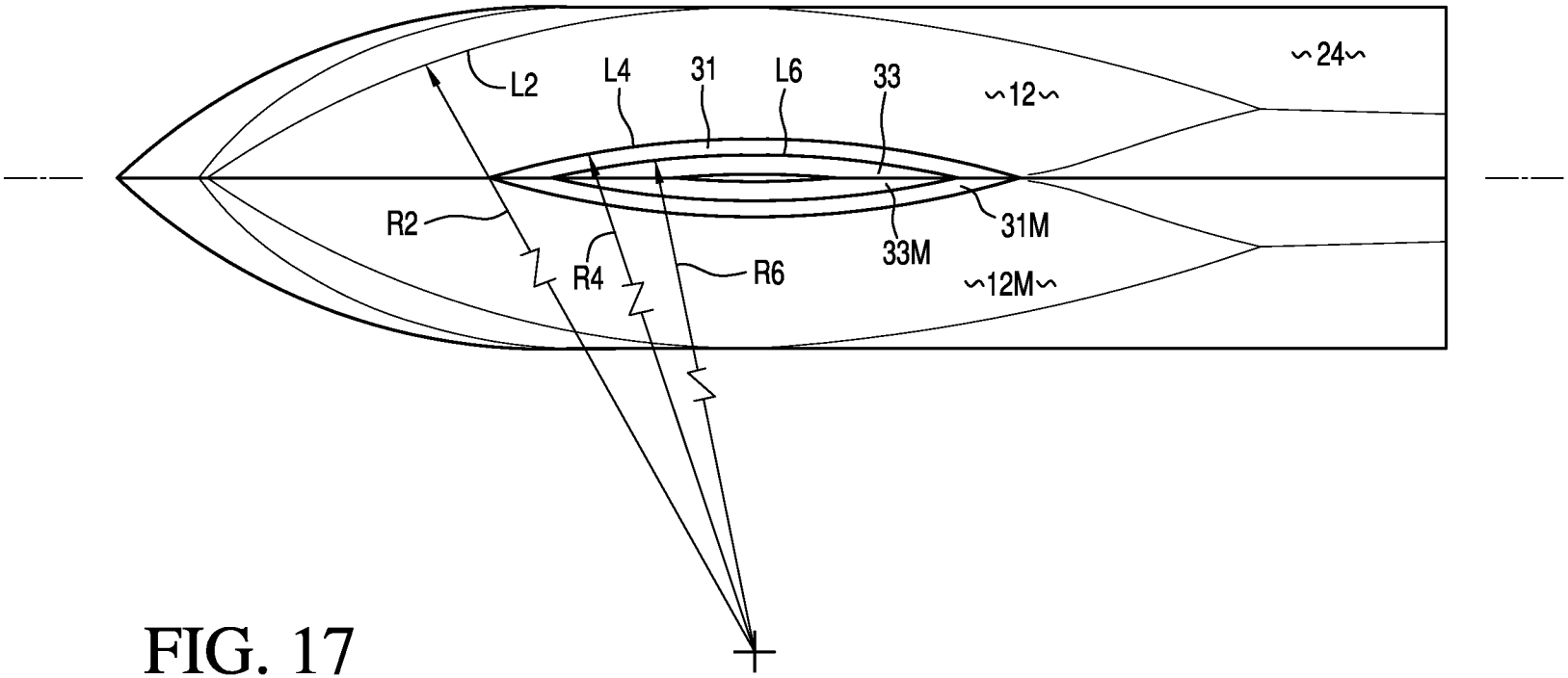
FIG. 17 shows a bottom view of a hull form constructed in accordance with the geometry illustrated in FIG. 16.

An alternative dual circular curved hull outer surface area formed in accordance with the invention is shown in FIGS. 16 and 17, where a boat hull 28 includes multiple vertically spaced dual circular curved outer hull surface areas 12, 31 and 33 on the same side of the plane of symmetry PS of the hull 28 connected one below the other to provide a continuous hull form. The dual circular curved outer surface area 12 in FIGS. 16 and 17 corresponds with dual circular curved outer surface area 12 described above, only in this embodiment the lower end of the first imaginary circular curved arc segment 14 used to define the first dual circular curved surface area 12 is terminated well before it tangentially approaches the plane of symmetry PS (or a plane extending parallel to the plane of symmetry PS on the same side of the plane of symmetry as the first center C1), although it extends in such direction in any case, and the lower circular curved outer surface areas 31 and 33 are formed in the same manner as the first dual circular curved outer surface area 12, only using third and fifth imaginary circular curved arc segments 30 and 32 having respective arc segment lengths L3 and L5, with respective radii R3 and R5 centered at centers C3 and C5 located on the same side of the plane of symmetry PS as center C1. Radii R3 and R5 are smaller than radius R1, as shown. To generate or create the respective dual circular curved outer surfaces 31 and 33 of the hull 28, the imaginary arc segments 30 and 32 are rotated or swept about rotation axis X in the same manner as the first imaginary circular curved arc segment 14 so that the loci of all points on the imaginary circular arc segments 30 and 32 trace secondary imaginary circular arc segments centered on rotation axis X, with the upper ends of the arc segments 30 and 32 tracing fourth and sixth secondary uppermost circular arc segments L4 and L6, respectively, the latter having respective radii R4 and R6, centered at respective centers C4 and C6 that are located one below the other along rotation axis X.

The extensions of the lower ends of the third and fifth imaginary circular curved arc segments 30 and 32 extend in a direction tangentially approaching the plane of symmetry PS (or optionally a plane PP extending parallel with the plane of symmetry Ps on the same side of the plane of symmetry as the respective centers C3 and C5), similar to the first imaginary circular curved arc segment 14, with the actual arc segments terminating at their lower ends before actually approaching the plane of symmetry PS in this embodiment to thereby provide for a wider beam and less hull depth (less draft).

The dual circular curved outer surface areas 12, 31 and 33 are provided in mirror form 12M, 31M and 33M on the opposite side of the hull plane of symmetry PS in the same manner as the embodiment described above involving a single dual circular curved outer surface area 12, as shown in FIG. 17.

The dual circular curved outer surface areas 12, 31 and 33 converge at the bow area of the hull 28 as shown in FIG. 17. A planing aft hull form similar to the planing aft hull form 24 may be provided aft of the circular curved hull forms 12, 31 and 33 shown in FIGS. 16 and 17 if desired, with a smooth transition being provided between the circular curved outer surface areas 12, 31 and 33, on the one hand, and the planing aft hull form 24 on the other hand.

While only 3 dual circular curved outer surface areas are shown in the embodiment of FIGS. 16 and 17, any number of such dual circular curved outer surface areas could be used as a boat hull outer surface area. This alternate embodiment may be used when it is desired to limit the hull depth and/or to expand the beam length for a given displacement of a boat provided with the described dual circular curved outer surface areas.

The invention includes the method aspects of forming the multiple dual circular curved outer surface areas 12, 31 and 33, using steps correlated with the method steps described above with regard to the first dual circular curved outer surface area 12 shown in FIGS. 1-16.

It is to be understood that this description and accompanying drawings describe preferred examples of the invention, and that actual embodiments of the invention may take other forms consistent with the inventive concepts underlying the invention herein described without departing from the full scope of the invention as described and claimed herein.

What is claimed:

1. A boat hull (10) having a vertical plane of symmetry (PS), a waterline plane (WP) including a waterline of the hull, and a vertical transverse beam plane (PB) including the hull beam, said hull comprising at least in part a first dual circular curved hull outer surface area (12) extending at least in part below the waterline plane (WP), said first dual circular curved hull outer surface area (12) being defined by a geometric area generated as a result of sweeping an first imaginary circular curved vertically oriented arc segment (14) located on one side of the plane of symmetry (PS) and having a first arc length (L1) and a first radius (R1) centered at a first center (C1) about an imaginary axis of rotation (X) extending vertically in the beam plane (PB), said first center (C1) being located below said waterline plane (WP) outboard of the hull on a same side of the plane of symmetry (PS) as the first imaginary circular curved arc segment (14), said first imaginary axis of rotation (X) being located on an opposite side of the plane of symmetry (PS) from the first center (C1), wherein said first imaginary circular curved vertically oriented arc segment (14) and first center (C1) are initially located in said beam plane (PB), with a lower end (15) of said first imaginary circular curved vertically oriented arc segment (14) or an extension of said lower end (15) approaching said plane of symmetry (PS) or a plane (PP) extending parallel with the plane of symmetry (PS) located on the same side of the plane of symmetry as the first center (C1) tangentially and an upper end (16) of said first imaginary circular curved vertically oriented arc segment (14) or an extension of an upper end (16) of said first imaginary circular curved vertically oriented arc segment (14) tangentially approaching the waterline plane (WP) or a plane extending parallel with the waterline plane (WP), the sweeping of the first imaginary circular curved vertically oriented arc segment (14) defining the first dual circular curved hull outer surface area (12) being caused by rotating the first imaginary circular curved vertically oriented arc segment (14) forward and aft of the beam plane (PB) about said imaginary axis of rotation (X) so that the loci of the upper end (16) of the first imaginary circular curved vertically oriented arc segment (14) fore and aft of the beam plane (PB) follow a second imaginary circular curved arc segment (18) having a second radius (R2) centered at a second center (C2) that is located on said imaginary axis of rotation (X), said second center (C2) and said second imaginary curved arc segment (18) being located in the waterline plane (WP) or a plane extending parallel with said waterline plane (WP), said second radius (R2) being greater than the first radius (R1), wherein all portions of the first dual circular curved hull outer surface area (12) defined by the geometric area resulting from sweeping the first imaginary circular curved vertically oriented arc segment (14) are located on the same side of the plane of symmetry (PS);

so that, said first dual circular curved hull outer surface area (12) comprises a circular curve form that is circular concave relative to the plane of symmetry (PS) when viewed horizontally parallel with the plane of symmetry (PS), and circular convex relative to the plane of symmetry (PS) when viewed vertically parallel with said plane of symmetry (PS), with said first dual circular curved hull outer surface area (12) extending in a vertical sense from a lower area at or approaching the plane of symmetry (PS) or a plane (PP) extending parallel to the plane of symmetry (PS) located on the same side of the plane of symmetry)PS) as the first center (C1), upwardly toward and approaching or intersecting the waterline plane (WP) or a plane extending parallel to said waterline plane (WP), and in a horizontal sense from an area forward of the beam plane (PB) to an area aft of the beam plane (PB).

2. The boat hull according to claim 1, including an opposite first dual circular curved hull outer surface area (12M) located on the opposite side of said plane of symmetry (PS) from said first dual circular curved hull outer surface area (12) and wherein said opposite first circular curved hull outer surface area (12M) is a mirror image of said first dual circular curved hull outer surface area (12).

3. The boat hull according to claim 2, wherein forward portions of said first and opposite dual circular curved hull outer surface areas (12, 12M) converge at the plane of symmetry (PS) forward of the beam plane (PB).

4. The boat hull according to claim 2, including a planing hull form (24) located in an area aft of said first and opposite dual circular curved hull outer surface areas (12, 12M).

5. The boat hull according to claim 4, said planing hull form (24) having a selected dead rise with a V center.

6. The boat hull according to claim 2, including bow extensions (22) of said first and opposite first dual circular curved hull outer surface areas (12, 12M) extending above the waterline plane (WP) of the boat hull over opposed forward portions of the hull.

7. The boat hull according to claim 1, including at least a second dual circular curved hull outer surface area (31) located below and inboard of said first dual circular curved hull outer surface area (12) on a same side of the plane of symmetry (PS) of the hull as said first dual circular curved hull outer surface area (12), said second dual circular curved hull surface area (31) being defined by a geometric area generated as a result of sweeping a third imaginary circular curved vertically oriented arc segment (30) located on the same side of the plane of symmetry (PS) as the first dual circular curved outer hull surface area (12) and having a third arc length (L3) and a third radius (R3) centered at third center (C3) about said imaginary axis of rotation (X), said third center (C3) being located below said waterline plane (WP) outboard of the hull on a same side of the plane of symmetry (PS) as the third imaginary circular curved vertically oriented arc segment (30), said third radius (R3) being smaller than the first radius (R1), wherein said third imaginary circular curved vertically oriented arc segment (30) and third center (C3) are initially located in said beam plane (PB), with a lower end of said third imaginary circular curved vertically oriented arc segment (30) or an extension of said lower end approaching said plane of symmetry (PS) or a plane (PP) extending parallel to said plane of symmetry (PS) located on the same side of said plane of symmetry as the third center (C3) tangentially and an upper end of said third imaginary circular curved vertically oriented arc segment (30) or an extension of an upper end of said third imaginary circular curved vertically oriented arc segment (30) tangentially approaching a plane extending parallel to and below the waterline plane (WP), the sweeping of the third imaginary circular curved vertically oriented arc segment (30) being caused by rotating the third imaginary circular curved vertically curved arc segment (30) forward and aft of the beam plane (PB) about the imaginary axis of rotation (X) so that the loci of an upper end of the third imaginary circular curved vertically oriented arc segment (30) fore and aft of the beam plane (PB) follow a fourth imaginary circular curved arc segment (L4) having a fourth radius (R4) centered at a fourth center (C4) that is located below the second center (C2) along the imaginary axis of rotation (X), said fourth radius (R4) being greater than the third radius (R3), said third imaginary circular curved vertically oriented arc segment (30) being located below and inboard of the first dual circular curved hull outer surface area (12), said fourth center (C4) and said fourth imaginary circular curved arc segment (L4) being located in a plane extending parallel with and below the waterline plane (WP), wherein all portions of the second dual circular curved hull outer surface area (31) defined by the geometric area resulting from sweeping said second imaginary circular curved vertically oriented arc segment (30) are located on the same side of the plane of symmetry (PS);

so that, said second dual circular curved outer hull surface area (31) comprises a circular curve form that is circular concave relative to the plane of symmetry (PS) when viewed horizontally parallel to the plane of symmetry (PS), and circular convex relative to the plane of symmetry (PS) when viewed vertically parallel to said plane of symmetry (PS), with said second circular curved hull outer surface area (31) extending in a vertical sense from a lower area at or approaching the plane of symmetry (PS) or a plane (PP) extending parallel to said plane of symmetry located on the same side of the plane of symmetry (PS) as the third center (C3) upwardly toward and approaching or intersecting a plane extending parallel to said waterline plane (WP), and in a horizontal sense from an area forward of the beam plane (PB) to an area aft of the beam plane (PB), and wherein said second dual circular curved hull outer surface area (31) intersects at an upper edge thereof a lower edge of the first dual circular curved outer hull surface area (12) and forms with said first dual circular curved hull outer surface area (12) a continuous hull outer surface area, with the second dual circular curved outer surface area (31) being closer to the plane of symmetry (PS) than the first dual circular curved hull outer surface area (12).

8. The boat hull according to claim 7, including an opposite second dual circular curved hull outer surface area (31M) that is a mirror image of said second dual circular curved hull outer surface area (31), and that is located on the opposite side of said plane of symmetry (PS) from said second dual circular curved hull outer surface area (31).

9. The boat hull according to claim 8, wherein forward portions of said dual circular curved hull outer surface areas (12, 31) converge at the plane of symmetry (PS) forward of the beam plane (PB).

10. The boat hull according to claim 8, including a planing hull form (24) located in an area aft of said dual circular curved hull outer surface areas (12, 31).

11. The boat hull according to claim 7, including a third dual circular curved hull outer surface area (33) located below and inboard of said second dual circular curved hull outer surface area (31) on a same side of the plane of symmetry (PS) of the hull as said first and second dual circular curved hull outer surface areas (12, 31), said third dual circular curved hull outer surface area (33) being defined by a geometric area generated as a result of sweeping a fifth imaginary circular curved vertically oriented arc segment (32) located on the same side of the plane of symmetry (PS) as the first and second dual circular curved hull outer surface areas (12, 31) and having a fifth arc length (L5) having a fifth radius (R5) centered at a fifth center (C5) about said imaginary axis of rotation (X), said fifth center (C5) being located below said waterline plane (WP) outboard of the hull on a same side of the plane of symmetry (PS) as the fifth imaginary circular curved vertically oriented arc segment (32), said fifth radius (R5) being smaller than the first radius (R1);

wherein said fifth imaginary circular curved vertically oriented arc segment (32) and fifth center (C5) are initially located in said beam plane (PB), with a lower end of said fifth circular arc segment or an extension of said lower end approaching said plane of symmetry (PS) or a plane (PP) extending parallel to said plane of symmetry (PS) located on the same side of the plane of symmetry as said fifth center (C5) tangentially and an upper end of said fifth imaginary circular curved vertically oriented arc segment (32) or an extension of an upper end of said third imaginary circular curved vertically oriented arc segment (32) tangentially approaching a plane extending parallel with and below the waterline plane (WP), the sweeping of the fifth imaginary circular curved vertically oriented arc segment (32) defining the third dual circular curved hull outer surface area (33) being caused by rotating the fifth imaginary circular curved vertically oriented arc segment (32) about said imaginary axis of rotation (X) forward and aft of the beam plane (PB) so that the loci of an upper end of the fifth imaginary circular curved vertically oriented arc segment (32) fore and aft of the beam plane (PB) follow a sixth imaginary circular curved arc segment (L6) having a sixth radius (R6) centered at a sixth center (C6) that is located along the imaginary axis of rotation (X) below the fourth center (C4), said fifth imaginary circular curved arc segment (32) being located below and inboard of the second circular curved hull outer surface area (31), said sixth center (C6) and said sixth imaginary circular curved arc segment (L6) being located in a plane extending parallel with and below the waterline plane (WP), said sixth center (C6) being located on an opposite side of the plane of symmetry (PS) from the fifth center (C5), said sixth radius (R6) being greater than the fifth radius (R5), wherein all portions of the third dual circular curved hull outer surface area (33) defined by the geometric area resulting from sweeping said third imaginary circular curved vertically oriented arc segment (32) are located on the same side of the plane of symmetry (PS), so that, said third dual circular curved hull outer surface area (33) comprises a circular curve form that is circular concave relative to the plane of symmetry (PS) when viewed horizontally parallel to the plane of symmetry (PS), and circular convex relative to the plane of symmetry (PS) when viewed vertically parallel to the plane of symmetry, with said third dual circular curved hull outer surface area (33) extending in a vertical sense from a lower area at or approaching the plane of symmetry (PS) or a plane (PP) extending parallel to the plane of symmetry (PS) located on the same side of the plane of symmetry (PS) as the fifth center (C5) upwardly toward and approaching or intersecting a plane extending parallel to said waterline plane, and in a horizontal sense from an area forward of the beam plane (PB) to an area aft of the beam plane (PB), and wherein said third dual circular curved hull outer surface area (33) intersects at an upper edge thereof a lower edge of the second circular curved hull outer surface area (31) and forms with said first and second circular curved hull outer surface areas (12, 31) a continuous dual circular curved hull outer surface area, with the third dual circular curved hull outer surface area (33) being closer to the plane of symmetry (PS) than the second dual circular curved hull outer surface area (31).

12. The boat hull according to claim 11, including an opposite third dual circular curved hull outer surface area (33M) that is a mirror image of said third dual circular curved hull outer surface area (33), and that is located on the opposite side of said plane of symmetry (PS) from said third dual circular curved hull outer surface area (33).

13. The boat hull according to claim 11, wherein the forward portions of said first, second and third dual circular curved hull outer surface areas (12, 31, 33) converge at the plane of symmetry (PS) forward of the beam plane (PB).

14. The boat hull according to claim 12, including a planing hull form (24) located in an area aft of said first, second and third dual circular curved hull outer surface areas (12, 31, 33).

15. A method of generating a form of a first dual circular curved outer surface area (12) of a boat hull, the hull having a waterline plane (WP), a vertical beam plane (PB) and a vertical plane of symmetry (PS), comprising the steps:

sweeping an imaginary first circular curved vertically oriented arc segment (14) located on one side of the plane of symmetry (PS) and having a first arc length (L1) and a first radius (R1) centered at a first center (C1) about an imaginary axis of rotation (X) extending vertically in the beam plane (PB) to generate a geometric area defining said first dual circular curved outer surface area (12), said first center (C1) being located below said waterline plane (WP) outboard of the hull on the same side of the plane of symmetry (PS) as the first imaginary circular curved vertically oriented arc segment (14), said imaginary axis of rotation (X) being located on an opposite side of the plane of symmetry (PS) from the first center (C1)

said imaginary first circular curved vertically oriented arc segment (14) and said first center (C1) initially being located in the vertical beam plane (PB), with said first imaginary circular curved vertically oriented arc segment (14) at a lower end (15) thereof, or an extension of said lower end, approaching tangentially said plane of symmetry (PS) or a plane (PP) extending parallel to said plane of symmetry (PS) located on the same side of the plane of symmetry (PS) as the first center (C1), and an upper end (16) of the first imaginary circular curved vertically oriented arc segment (14), or an extension of said upper end (16), approaching tangentially the waterline plane (WP), or a plane extending parallel with the waterline plane (WP), the sweeping of the first imaginary circular curved vertically oriented arc segment (14) being carried out so as to rotate the first imaginary circular curved vertically oriented arc segment (14) forward and aft of the beam plane (PB) so the loci of an upper end (16) of the first imaginary circular curved vertically oriented arc segment (14) forward and aft of the beam plane (PB) follow a second imaginary circular curved arc segment (18) centered at a second center (C2), said second center (C2) being located on said axis of rotation (X), said second center (C2) and said second imaginary circular curved arc segment (18) being located in the waterline plane (WP) or a plane extending parallel with said waterline plane (WP), said second radius (R2) being greater than the first radius (R1), while rotating the first imaginary circular curved vertically oriented arc segment (14) fore and aft of the beam plane (PB), maintaining all of the geometric area resulting from sweeping said first imaginary circular curved vertically oriented arc segment (14) defining the first hull outer surface (12) on the same side of the plane of symmetry (PS), so that the first dual circular curved hull outer surface area (12) is formed as a curve that is circular concave relative to the plane of symmetry (PS) when viewed horizontally parallel to the plane of symmetry (PS), and circular convex relative to the plane of symmetry (PS) when viewed vertically parallel to the plane of symmetry (WP), with said first dual circular curved hull outer surface area (12) extending in a vertical sense from a bottom area at or approaching the plane of symmetry (PS) or a plane (PP) extending parallel to the plane of symmetry (PS) located on the same side of the plane of symmetry (PS) as the first center (C1) upwardly toward and intersecting the waterline plane (WP) or a plane extending parallel with said waterline plane (WP), and in a horizontal sense from an area forward of the beam plane (PB) to an area aft of the beam plane (PB).

16. The method according to claim 15, including forming an extension (22) of the dual circular curved hull outer surface area (12) above the waterline plane (WP) at a hull bow area.

17. The method according to claim 15, including forming an opposite first dual circular curved hull outer surface area (12M) in mirror image of said first dual circular curved hull outer surface area (12) on an opposite side of the plane of symmetry (PS) from the first dual circular curved hull surface area (12).

18. The method according to claim 15, including forming forward portions of said first and opposite first dual circular curved hull outer surface areas (12, 12M) so they converge at the plane of symmetry (PS) forward of the beam plane (PB).

19. The method according to claim 18, including forming a planing hull form (24) aft of the first and opposite first dual circular curved hull outer surface areas (12, 12M)), including forming a smooth transition area along the hull between the first and opposite dual circular curved outer hull surface areas (12,12*a*) and the planing hull form (24).

20. The method according to claim 15, including forming a second dual circular curved hull outer surface area (31) located below and inboard of said first dual circular curved hull outer surface area (12) on a same side of the plane of symmetry (PS) of the hull as said first dual circular curved hull outer surface area (12), generating the shape of said second dual circular curved hull surface area (31) by sweeping a third imaginary circular curved vertically oriented arc segment (30) located on the same side of the plane of symmetry (PS) as the first dual circular curved hull outer surface area (12) and having a third arc length (L3) having a third radius (R3) centered at a third center (C3) about said imaginary axis of rotation (X), wherein said third center (C3) is located below said waterline plane (WP) outboard of the hull on a same side of the plane of symmetry (PS) as the third imaginary circular curved vertically oriented arc segment (30), said third radius (R3) being smaller than the first radius (R1), said third imaginary circular curved vertically oriented arc segment (30) being located below and inboard of the first hull outer surface area (14), wherein said imaginary third imaginary circular curved vertically oriented arc segment (30) and the third center (C3) are initially located in said beam plane (PB), with a lower end of said third imaginary circular curved vertically oriented arc segment (30) or an extension of said lower end approaching said plane of symmetry (PS) or plane (PP) extending parallel with said plane of symmetry (PS) located on the same side of the plane of symmetry (PS) as said third center (C3) tangentially and an upper end of said third imaginary circular curved vertically oriented arc segment (30) or an extension of an upper end of said third circular curved vertically oriented arc segment (30) tangentially approaching a plane extending parallel to and below the waterline plane (WP), causing the sweeping of the imaginary third imaginary circular curved vertically oriented arc segment (30) defining the second dual circular curved hull outer surface area (31) by rotating the third imaginary circular curved vertically oriented arc segment (30) fore and aft of the beam plane (PB) about the imaginary axis of rotation (X) so that the loci of an upper end of the third imaginary circular curved vertically oriented arc segment fore and aft of the beam plane (PB) follow a fourth imaginary circular curved arc segment (L4) having a fourth radius (R4) centered at a fourth center (C4) that is located below the second center (C2) along the imaginary axis of rotation (X), said fourth radius (R4) being greater than the third radius (R3), said fourth center (C4) and said fourth imaginary circular curved arc segment (L4) being located in a plane extending parallel with and below said waterline plane (WP), wherein all portions of the second dual circular curved hull outer surface area (31) defined by the geometric area resulting from sweeping said second imaginary circular curved vertically oriented arc segment (30) are located on the same side of the plane of symmetry (PS), so that, said second dual circular curved hull outer surface area (31) comprises a circular curve form that is circular concave relative to the plane of symmetry (PS) when viewed horizontally along the plane of symmetry (PS) and circular convex relative to the plane of symmetry (PS) when viewed vertically along the plane of symmetry (WP), with said second dual circular curved hull outer surface area (31) extending in a vertical sense from a lower area at or approaching the plane of symmetry (PS) or a plane (PP) extending parallel with said plane of symmetry (PS) located on the same side of the plane of symmetry as the third center (C3) upwardly toward and approaching or intersecting a plane extending parallel to said waterline plane, and in a horizontal sense from an area forward of the beam plane (PB) to an area aft of the beam plane (PB), and locating said second dual circular curved hull outer surface area (31) so that it intersects at an upper edge thereof a lower edge of the first dual circular curved outer hull surface area (12) and forms with said first dual circular curved hull outer surface area (12) a continuous hull outer surface area, with the second dual circular curved hull outer surface area (31) being closer to the plane of symmetry (PS) than the first dual circular curved hull outer surface area (12).

21. The method according to claim 20, including forming an opposite second dual circular curved outer hull outer surface area (31M) in mirror image of said second dual circular curved hull outer surface area (31) on an opposite side of the plane of symmetry (PS) from the second circular curved hull outer surface area.

22. The method according to claim 20, including forming a planing hull bottom area (24) aft of the dual circular curved hull outer surface areas (12, 31), including forming a smooth transition area along the hull between the circular curved first and second dual circular curved outer hull surface areas (12, 31) and the planing hull bottom area.

23. The method according to claim 20, including forming a third dual circular curved hull outer surface area (33) located vertically below and inboard of said second dual circular curved hull outer surface area (31) on a same side of the plane of symmetry (PS) of the hull as said first and second dual circular curved hull outer surface areas (12, 31), generating the shape of said third dual circular curved hull outer surface area (31) by sweeping a fifth imaginary circular curved vertically oriented arc segment (32) located on the same side of the plane of symmetry (PS) as the first and second dual circular curved outer surface area 12, 31 having a fifth arc length (L5) having a fifth radius (R5) centered at a fifth center (C5) about said imaginary axis of rotation (X), said fifth center (C5) being below said waterline plane (WP) outboard of the hull on a same side of the plane of symmetry (PS) as the fifth imaginary circular curved arc segment (32), said fifth radius (R5) being smaller than the first radius (R1), said fifth imaginary circular curved arc segment (32) being located below and inboard of the second dual circular curved hull outer surface area (31), wherein said fifth imaginary circular curved arc segment (32) and said fifth center (C5) are initially located in said beam plane (PB), with a lower end of said fifth circular curved arc segment (32) or an extension of said lower end approaching said plane of symmetry (PS) or a plane (PP) extending parallel with said plane of symmetry (PS) located on the same side of the plane of symmetry as the fifth center (C5) tangentially and an upper end of said fifth imaginary circular curved arc segment (32) or an extension of an upper end of said fifth imaginary circular curved arc segment (32) tangentially approaching a plane extending parallel with and below the waterline plane (WP), causing sweeping of the fifth imaginary circular curved vertically oriented arc segment (32) defining the third circular curved hull outer surface area (33) by rotating the fifth imaginary circular curved vertically oriented arc segment (32) about the imaginary axis of rotation (X) forward and aft of the beam plane (PB) so that the loci of an upper end of the fifth imaginary circular curved vertically oriented arc segment (32) fore and aft of the beam plane (PB) follow a sixth imaginary circular curved arc segment (L6) having a sixth radius (R6) centered at a sixth center (C6) that is located below said fourth center (C4) along said imaginary axis of rotation (X), said sixth radius (R6) being greater than the fifth radius (R5), said sixth center (C6) and said imaginary sixth imaginary circular curved arc segment (L6) being located in a plane extending parallel with and below said waterline plane (WP), wherein all portions of the third dual circular curved hull outer surface area (33) defined by the geometric area resulting from sweeping said third imaginary circular curved arc segment (32) are located on the same side of the plane of symmetry (PS), so that, said third dual circular curved hull outer surface area (33) comprises a circular curve form that is circular concave relative to the plane of symmetry (PS) when viewed horizontally along the plane of symmetry (PS) and circular convex relative to the plane of symmetry (PS) when viewed vertically along the plane of symmetry (WP), with said third dual circular curved hull outer surface area (33) extending in a vertical sense from a lower area at or approaching the plane of symmetry (PS) or a plane (PP)extending parallel with the plane of symmetry(PS) located on the same side of the plane of symmetry as the fifth center (C5) upwardly toward and approaching or intersecting a plane extending parallel to said waterline plane, and in a horizontal sense from an area forward of the beam plane (PB) to an area aft of the beam plane (PB), and locating said third dual circular curved hull outer surface area (33) so that it intersects at an upper edge thereof a lower edge of the second dual circular curved outer hull surface area (31) and forms with said first and second dual circular curved hull outer surface areas (12, 31) a continuous dual circular curved hull outer surface area, with the third dual circular curved hull outer surface area (33) being closer to the plane of symmetry (PS) than the second dual circular curved hull outer surface area (31).

24. The method according to claim 23, including forming an opposite third dual circular curved hull outer surface area (12*b*M) in mirror image of said third dual circular curved hull outer surface area (33) on an opposite side of the plane of symmetry (PS) from the third dual circular curved hull outer surface area (12*b*).

25. The method according to claim 24, including forming the forward portions of said dual circular curved hull outer surface areas (12, 31, 33) so they converge at the plane of symmetry (PS) forward of the beam plane (PB).

26. The method according to claim 24, including forming a planing hull form (24) located in an area aft of said dual circular curved hull outer surface areas (12, 31, 33).

* * * * *